US006379132B1

(12) United States Patent
Williams

(10) Patent No.: US 6,379,132 B1
(45) Date of Patent: Apr. 30, 2002

(54) FUEL PUMP

(75) Inventor: Anthony John Williams, Isleworth (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/626,494

(22) Filed: Jul. 27, 2000

(30) Foreign Application Priority Data

Jul. 30, 1999 (GB) ..... 9917998

(51) Int. Cl.[7] ..... F04B 19/00; F04B 49/00; F01L 1/34

(52) U.S. Cl. ..... 417/470; 417/302; 123/90.16

(58) Field of Search ..... 417/470, 302; 123/90.16; 239/585

(56) References Cited

U.S. PATENT DOCUMENTS 4,272,027 A * 6/1981 Seilly et al. ..... 239/585
4,276,000 A * 6/1981 Warwicker ..... 417/302
4,395,979 A * 8/1983 Perr ..... 123/90.16
5,992,767 A * 11/1999 Phillips et al. ..... 239/533.8

FOREIGN PATENT DOCUMENTS

GB WO 93/21439 * 10/1993

* cited by examiner

*Primary Examiner*—Charles G. Freay
*Assistant Examiner*—Michael K. Gray
(74) *Attorney, Agent, or Firm*—Thomas A. Twomey

(57) ABSTRACT

A fuel pump comprising a pumping plunger reciprocable within a bore, and a drive arrangement for driving the pumping plunger. The drive arrangement includes a compressible load transmission arrangement for transmitting movement of the drive arrangement to the pumping plunger. The load transmission arrangement comprises first and second surfaces which define, therebetween, a chamber for fluid. The fuel pump also comprises supply means for permitting the chamber to be supplied with fluid, in use, and control means for controlling the flow of fluid from the chamber.

11 Claims, 2 Drawing Sheets

FUEL PUMP

TECHNICAL FIELD

This invention relates to a fuel pump for supplying fuel under pressure for delivery to a combustion space of a compression ignition internal combustion engine.

BACKGROUND OF THE INVENTION

It is known to provide each injector of a fuel system with a corresponding fuel pump arranged to supply fuel under pressure only to that fuel injector. The pump and associated fuel injector may be mounted upon one another or spaced apart from one another, a fuel pipe being used to connect to pump outlet to the injector. The pumps used in such applications typically comprise a pumping plunger reciprocable within a bore under the action of a cam and tappet arrangement. The pump and associated components are designed such that, at any instant, the speed of movement of the plunger is governed by the speed of rotation of the cam and by the shape of the cam profile.

In order to reduce the levels of noise and particulate emissions produced by an engine, it is desirable, under some conditions, to arrange for each injection of fuel to the engine to include a period during which fuel is injected at a reduced rate. For example, each injection may include an initial part during which fuel is delivered at a relatively low rate followed by a period during which fuel injection occurs at a higher rate. In known arrangements, this has been achieved by appropriate shaping of the cam profile.

SUMMARY OF THE INVENTION

According to the present invention, there is provided a fuel pump comprising a pumping plunger reciprocable within a bore, and a drive arrangement for driving the pumping plunger, the drive arrangement including a compressible load transmission arrangement for transmitting movement of the drive arrangement to the pumping plunger, the load transmission arrangement comprising first and second surfaces which define, therebetween, a chamber for fluid, and supply means for permitting the chamber to be supplied with fluid, in use, and control means for controlling the flow of fluid from the chamber.

The provision of the load transmission arrangement results in some of the movement of the drive arrangement being absorbed, by compression of the fluid and by fluid escaping from the chamber, and hence in the plunger moving at a reduced rate than would otherwise be the case for a period. As a result, an associated injector can be operated in such a manner as to include, in its injection cycle, a period during which fuel is injected at a reduced rate.

The stiffness of the load transmission arrangement may vary with, for example, the applied load, and a plunger movement may be achieved which is not possible simply by modifying the profile of the cam.

The first and second surfaces are conveniently resiliently biased apart, for example by one or more disc springs. The supply means conveniently includes a non-return valve whereby fluid can be supplied to the chamber upon separation of the surfaces under the action of the resilient biasing. The non-return valve may comprise a perforated diaphragm. The disc springs are conveniently arranged such that, in use, when the load applied to the device exceeds a predetermined level the disc springs deflect to define a fluid flow path whereby fluid can escape from the chamber in a controlled manner.

Preferably, the fluid supplied to the engine is engine lubricating oil.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
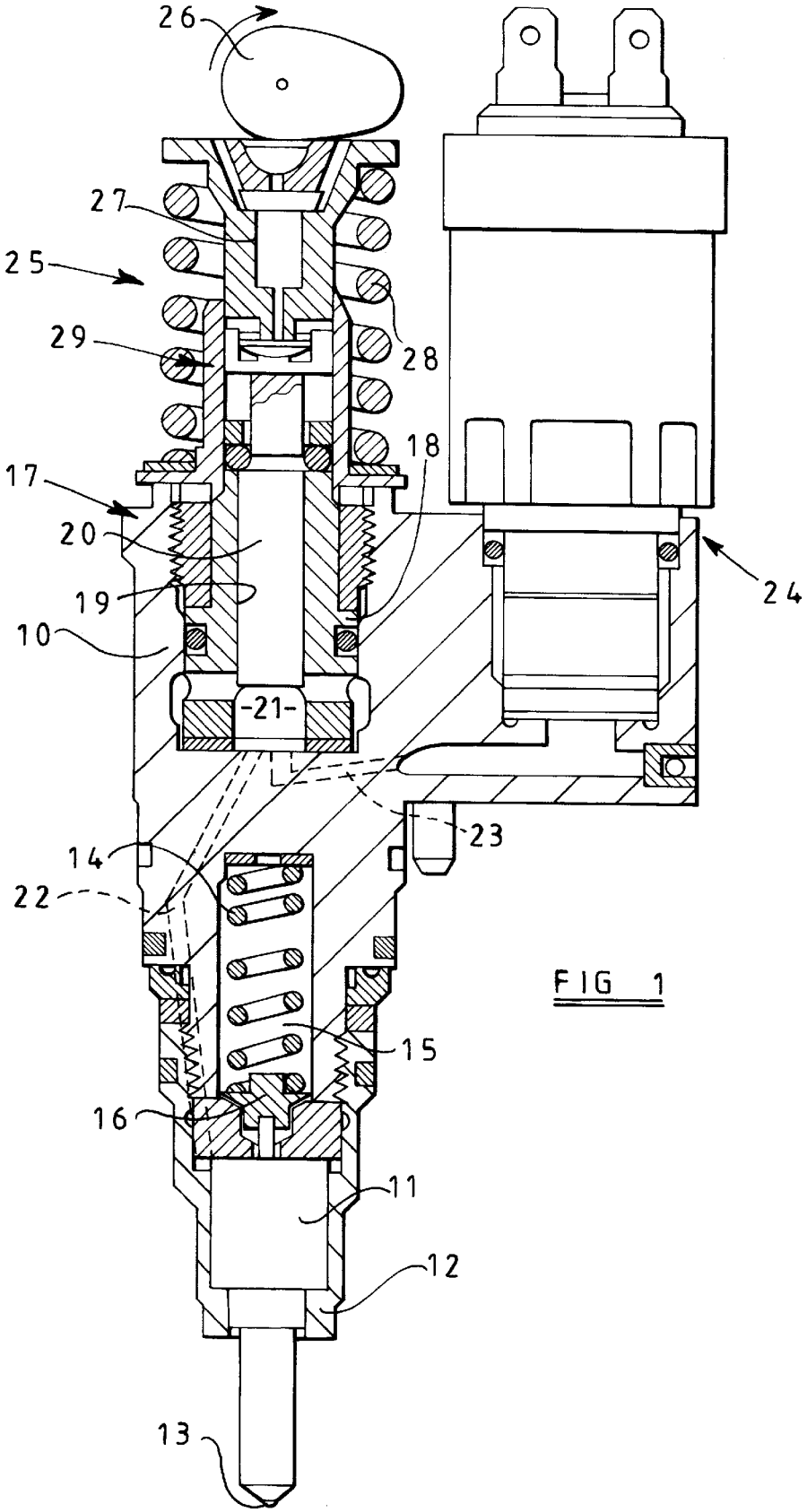
FIG. 1 is a sectional view illustrating a unit pump/injector in accordance with an embodiment of the invention.

The unit pump injector illustrated in FIG. 1 comprises a nozzle holder 10 to which a nozzle body 11 is secured by means of a cap nut 12. The nozzle body 11 is provided with a blind bore within which a valve needle is slidable, the valve needle being engageable with a seating to control the delivery of fuel past the seating to a plurality of outlet openings 13 which open into the bore downstream of the seating. The needle is biased towards the seating by means of a spring 14 located within a spring chamber 15 defined by a blind bore formed in the nozzle holder 10, the spring 14 engaging a spring abutment member 16 carried by an end of the needle remote from the end which is engageable with the seating. The needle is shaped to include angled surfaces orientated such that the application of fuel under pressure to the surfaces applies a force to the needle urging the needle away from its seating against the action of the spring 14. Fuel under pressure is supplied to the thrust surfaces of the needle by means of a pump 17 mounted in the nozzle holder 10.

The pump 17 comprises a pump housing 18 within which a through bore 19 is formed, a plunger 20 being reciprocable within the bore 19. The plunger 20, bore 19 and a surface of the nozzle holder 10 together define a pumping chamber 21 which communicates through a passage 22 with a chamber defined between the nozzle body 11 and the needle, the thrust surfaces of the needle being exposed to the fuel pressure within this chamber. The pumping chamber 21 further communicates through a passage 23 with a port of an electro-magnetically operable spill valve arrangement 24. The spill valve arrangement 24 controls communication between the pumping chamber 21 and a relatively low pressure fuel reservoir (not shown).

The pumping plunger 20 is reciprocable under the control of a drive arrangement 25 which comprises a rotatable cam 26 arranged to drive a tappet 27 against the action of a return spring 28. Inward movement of the tappet 27 is transmitted to the plunger 20 through a compressible load transmission arrangement 29 which is illustrated most clearly in FIG. 2. Although the cam 26 is illustrated as engaging the tappet 27, it will be appreciated that a rocker arrangement may be used to transmit the cam load to the tappet 27.

The transmission arrangement 29 comprises a hollow cylindrical housing member 30, the lower end of which is closed by an integral wall 31. An upper closure member 32 is located to close the upper end of the member 30, a circlip 33 being used to secure the upper closure member 32 in position. As illustrated, the upper closure member 32 is provided with an axially extending opening through which the tappet 27 extends. The lower end of the tappet 27 is arranged to engage a load transmitting member 34 of circular form which is located within a chamber defined between the member 30 and the member 32. The load transmitting member 34 includes an axially extending drilling 35 which communicates with a drilling formed in the tappet 27, the drilling of the tappet 27 being connected, in use, to a reservoir containing engine lubricating oil. Where a rocker arrangement is used, the drilling of the tappet 27 may be supplied with lubricating oil from an oil duct associated with the rocker arrangement, such a supply being more consistent than relying upon splash feeding of oil as may occur where the cam 26 engages the tappet 27 directly.

The lower surface of the load transmitting member 34 is engaged by a diaphragm 36 which is perforated or provided with slits whereby part of the diaphragm 36 is able to lift away from the load transmitting member 34 to permit engine lubricating oil to flow through the drilling 35 into a chamber 37 defined beneath the diaphragm 36. The diaphragm 36 and load transmitting member 34 are biased away from the wall 31 by a pair of disc springs 38, 39 which define the outer periphery of the chamber 37, the wall 31 forming the lower surface of the chamber 37. The wall 31 includes, at its center, a projection 31*a* which defines a stop surface against which the diaphragm 36 can engage, limiting movement of the load transmitting member 34 towards the wall 31. The wall 31 and the diaphragm 36 form first and second surfaces 43, 44 which are biased away from one another and which define the chamber 37. The disc springs 38, 39 serve to bias the surfaces 43, 44 away from one another.

Figure 2:
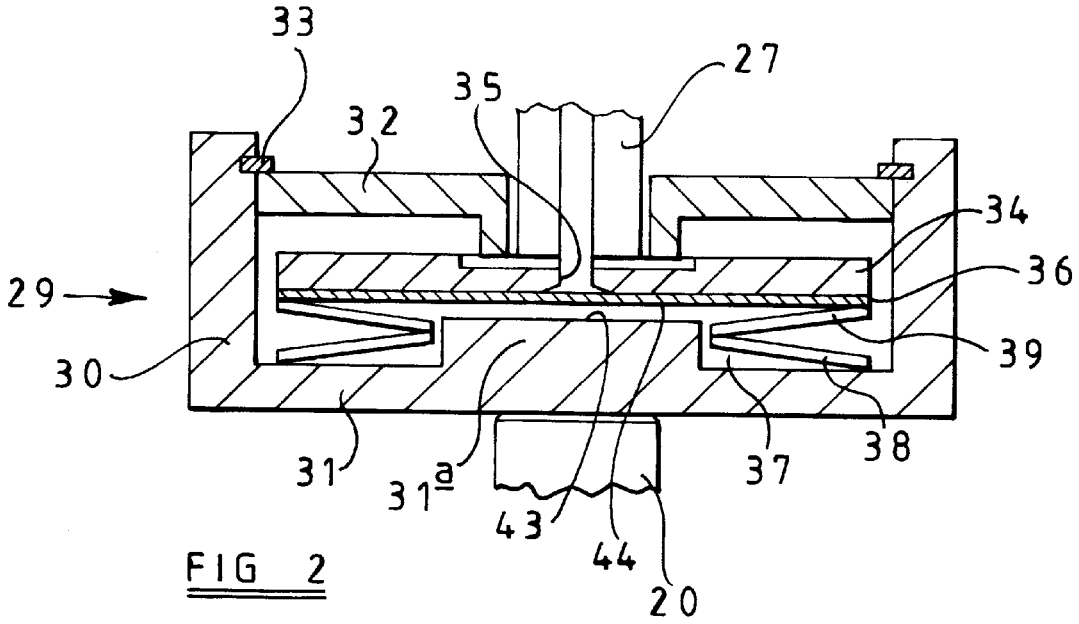
FIG. 2 is an enlarged view illustrating part of the unit pump/injector of FIG. 1.

In use, starting from the position illustrated in FIGS. 1 and 2, the plunger 20 occupies an outer position, the pumping chamber 21 being charged with fuel at relatively low pressure. As the pumping chamber 21 is at relatively low pressure, the force applied to the needle by the action of the fluid upon the thrust surfaces thereof is insufficient to move the needle away from its seating, thus the needle is held in engagement with its seating by the spring 14 and fuel injection is not taking place. The spill valve 24 is controlled in such a manner than communication is permitted between the pumping chamber 21 and the low pressure fuel reservoir.

Rotation of the cam 26 in a clockwise direction results in the tappet 27 being pushed inwards. The load applied by the tappet 27 is transmitted through the load transmitting member 34 and diaphragm 36 to the lubricating oil located within the chamber 37. As a result, the oil within the chamber 37 is pressurized forcing the diaphragm 36 against the load transmitting member 34 to a position in which the drilling 35 is closed. It will be appreciated, therefore, that engine oil is unable to escape from the chamber 37 through the drilling 35, and the load applied by the tappet 27 is transmitted through the engine oil and the disc springs 38, 39 to the wall 31 and to the pumping plunger 20 moving the pumping plunger 20 to displace fuel from the pumping chamber 21 through the spill valve 24 to the low pressure fuel reservoir. The movement of the plunger 20 during this part of the operation of the pump does not significantly pressurize the fuel within the pumping chamber 21, thus fuel injection does not take place. During this phase of the operation, the disc springs 38, 39 engage one another and the surfaces 43, 44 in a substantially fluid tight manner thus the oil is confined within the chamber 37.

When fuel injection is required to commence, the spill valve 24 is operated to break the communication between the pumping chamber 21 and the low pressure fuel reservoir. Continued movement of the cam 26 results in further downward movement of the tappet 27. The movement of the tappet 27 is transmitted to the plunger 20 as described hereinbefore. As the spill valve 24 is closed, the movement of the plunger 20 pressurizes the fuel within the pumping chamber 21, the increase in fuel pressure within the pumping chamber 21 being transmitted to the injector needle, increasing the magnitude of the force applied to the thrust surfaces of the needle urging the needle away from its seating. A point will be reached beyond which the needle is able to lift against the action of the spring 14, thus commencing injection.

It will be appreciated that once the spill valve 24 is closed, an increased load must be applied to the pumping plunger 20 in order to cause movement of the plunger 20. The increase in the load which must be applied to the plunger 20 results in the engine lubricating oil located within the chamber 37 compressing, and in a load being applied to the disc springs 38, 39 causing the disc springs to deflect allowing some of the oil to escape from the chamber 37 along a flow path defined between the disc springs 38, 39. Thus, during part of the operation of the pump 17 to pressurize the fuel within the pumping chamber 21, there is period during which the pumping plunger 20 moves at a rate slower than the rate at which the tappet 27 is moving. As a result of the reduction in the rate at which the pumping plunger 20 is being moved, the rate at which fuel is supplied towards the outlet openings is reduced, thus the injection of fuel by the unit pump/injector includes a period during which the injection rate is relatively low. After the lubricating oil within the chamber 37 has been compressed and sufficient oil has escaped from the chamber 37 to allow movement of the diaphragm 36 into engagement with the surface of the projection 31*a*, then further movement of the tappet 27 is transmitted directly to the wall 31 and to the plunger 20. Thus, beyond this point, the plunger 20 moves at the same rate as the tappet 27 and fuel injection takes place at a higher rate than the initial rate of injection.

It will be appreciated that during the part of the operating cycle in which the pumping plunger 20 moves at a reduced rate, the rate at which the load transmitting arrangement is compressed depends upon the applied load, the volume of the chamber 37, the compressibility of the oil, the rate at which the oil can escape from the chamber 37 which is governed, in part, by the nature and deflection of the disc springs 38, 39, and the magnitude of the load applied by the disc springs 38, 39. These parameters may be chosen to suit the application in which the pump is to be used.

When it is desired that injection should be terminated, the spill valve 24 is operated to restore the communication between the pumping chamber 21 and the low pressure fuel reservoir. As a result, the fuel pressure within the pumping chamber 21 falls rapidly and the magnitude of the force applied to the needle urging the needle away from its seating also falls, the needle returning into engagement with its seating under the action of the spring 14. As the magnitude of the force against which the plunger 20 is moving is reduced, the magnitude of the compressive load on the lubricating oil within the chamber 37 falls, and a point will be reached beyond which the load transmitting member 34 moves under the influence of the disc springs 38, 39 to the position illustrated, increasing the separation of the surfaces 43, 44 and increasing the volume of the chamber 37. During such movement of the load transmitting member 34, as the oil pressure within the chamber 37 falls, the diaphragm 36 may be able to lift away from the load transmitting member 34 to open the drilling 35 such that oil can flow to the chamber 37 to compensate for the loss of oil from the chamber 37, in use, between the disc springs 38, 39.

Figure 3:
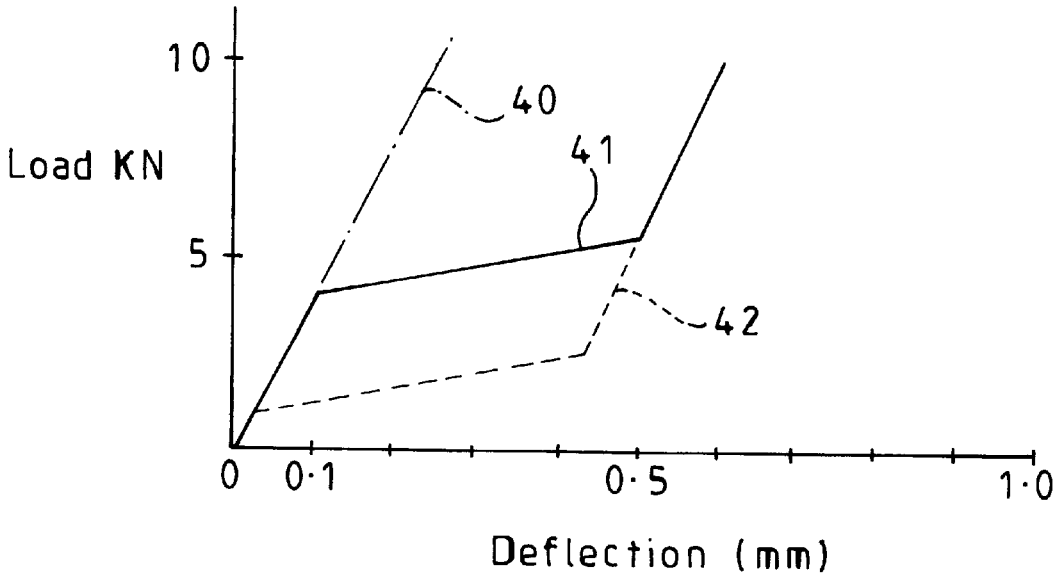
FIG. 3 is a graph showing the relationship between the load applied to the drive arrangement of the unit pump/injector and the distance moved by the pumping plunger of the unit pump/plunger.

FIG. 3 is a graph illustrating the displacement or deflection of the pumping plunger 20 under various conditions. The line 40 represents the displacement of the plunger for a given applied load where the load transmitting means is omitted. The line 41 illustrates the case where the load transmitting means is present and the tappet 27 is being moved in an inward direction. As illustrated, initially the line 41 follows the line which would be present for the conventional case which does not include the load transmitting device. When the pre-load applied by the disc springs 38, 39 and the oil under pressure within the chamber 37 is overcome, then a period commences during which the movement of the plunger occurs at a lower rate, the load transmitting arrangement compressing during this part of the operation due to compression and escape of the fluid from the chamber, the rate of movement of the plunger being restored upon movement of the diaphragm 36 and load transmitting member 34 into engagement with the surface of the projection 31*a*. The line 42 illustrates the relationship when the load applied to the plunger 20 is reduced. As, during this part of the operation of the load transmitting device, oil can flow to the chamber 37 through the drilling 35 at a substantially unrestricted rate, the disc springs 38, 39 are not being influenced by the oil pressure within the chamber 37 and the extension of the load transmitting device occurs at a lower load than that which causes compression of the load transmitting device.

Rather than using disc springs to control the manner in which fluid is able to escape from the chamber, it will be appreciated that an alternative control arrangement, for example in the form of a valve or flow restriction or a combination thereof could be used.

Although the description hereinbefore is of a unit pump/injector, it will be appreciated that the invention is applicable to other types of pump, for example a unit pump the outlet of which is connected to an injector, in use, through a suitable high pressure fuel pipe. It will further be appreciated that the load transmitting device need not be provided exactly in the position illustrated.

What is claimed is:

1. A fuel pump of the type having a pump housing defining a bore and a plunger reciprocal in said bore, and further including a tappet having a non-pressurized fluid supplying passageway with an outlet at one end, said tappet extending into said bore for driving said plunger to pressurize fuel in a pumping chamber for delivery of the fuel to a fuel injector, said fuel pump further including a load transmission apparatus interposed between said tappet and said plunger, said load transmission apparatus comprising:

an enclosed housing defining a first chamber therein, said housing defining an aperture through a top thereof receiving therethrough said end of said tappet having said outlet;

a member within said housing and abutted to said tappet end, said member defining a second chamber therein in fluid communication with said tappet outlet when said tappet is not transmitting a load, said member resiliently biased to an extended position and movable to a compressed position when loaded by said tappet.

2. A fuel pump according to claim 1 wherein said member within said housing includes a load transmitting member, said load transmitting member having a drilling in axial alignment with said tappet outlet.

3. A fuel pump according to claim 2 wherein said second chamber is defined by a diaphragm on top, said bottom of said enclosed housing, and a biasing member separating said diaphragm from said bottom, said diaphragm removably abuttable to said load transmitting member.

4. A fuel pump according to claim 3 wherein said bottom includes a projection extending into said second chamber.

5. A fuel pump according to claim 3 wherein said diaphragm is perforated.

6. A fuel pump according to claim 5 wherein said perforated diaphragm defines a plurality of slits therethrough, said slits in other than axial alignment with said drilling in said load transmitting member.

7. A fuel pump according to claim 5 wherein said biasing member comprises at least two disc springs, said springs deflectable to define a fluid flow path whereby fluid can escape from said second chamber in a controlled manner when said member within said housing is compressed.

8. A fuel pump according to claim 5 wherein said diaphragm is removably abuttable to said load transmitting member when said tappet is unloaded, said second cavity receiving fluid when said diaphragm removed from said load transmitting member.

9. A fuel pump according to claim 8 wherein said diaphragm fluidly seals said drilling in said load transmitting member when said tappet applies a load to said load transmitting member.

10. A fuel pump comprising a pumping plunger reciprocal within a bore, and a drive arrangement for driving said pumping plunger, wherein said drive arrangement includes:

a compressible load transmission arrangement for transmitting movement of the drive arrangement to said pumping plunger, said load transmission arrangement comprising first and second surfaces which define a fluid chamber therebetween;

a supply arrangement for permitting said chamber to be supplied with fluid in use, said supply arrangement including a construction whereby said first surface comprises a perforated diaphragm and is biased away from said second surface such that fluid can be supplied to said chamber upon separation of said diaphragm and second surface by said biasing after compression of said compressible load transmission arrangement and a control arrangement for controlling the flow of fluid from said chamber.

11. A fuel pump comprising a pumping plunger reciprocal within a bore, and a drive arrangement for driving said pumping plunger, wherein said drive arrangement includes:

a compressible load transmission arrangement for transmitting movement of the drive arrangement to said pumping plunger, said load transmission arrangement comprising first and second surfaces which define a fluid chamber therebetween;

a supply arrangement for permitting said chamber to be supplied with fluid in use, and;

a control arrangement for controlling the flow of fluid from said chamber comprises at least two disc springs arranged to bias apart said first and said second surfaces such that, in use, when a load is applied to said load transmission arrangement and the load exceeds a predetermined level, said disc springs deflect to define a fluid flow path whereby fluid can escape from said chamber in a controlled manner.

comprising a pumping plunger reciprocal within a bore, and a drive arrangement for driving the pumping plunger, wherein the drive arrangement includes:

a compressible load.

* * * * *